US007899657B2

(12) United States Patent
Martin

(10) Patent No.: US 7,899,657 B2
(45) Date of Patent: Mar. 1, 2011

(54) MODELING IN-SITU RESERVOIRS WITH DERIVATIVE CONSTRAINTS

(75) Inventor: Gregory D. Martin, Georgetown, TX (US)

(73) Assignee: Rockwell Automoation Technologies, Inc., Mayfield Heights, OH (US)

( * ) Notice: Subject to any disclaimer, the term of this patent is extended or adjusted under 35 U.S.C. 154(b) by 1944 days.

(21) Appl. No.: 10/350,838

(22) Filed: Jan. 24, 2003

(65) Prior Publication Data

US 2004/0148147 A1 Jul. 29, 2004

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS

| | | | | |
|---|---|---|---|---|
| 5,444,619 | A | 8/1995 | Hoskins et al. | |
| 6,002,985 | A | 12/1999 | Stephenson | |
| 6,047,221 | A * | 4/2000 | Piche et al. | 700/44 |
| 6,101,447 | A | 8/2000 | Poe, Jr. | |
| 6,236,894 | B1 | 5/2001 | Stoisits et al. | |
| 6,256,603 | B1 | 7/2001 | Celniker | |
| 6,278,899 | B1 | 8/2001 | Piche et al. | |
| 6,434,435 | B1 | 8/2002 | Tubel et al. | |
| 6,662,109 | B2 * | 12/2003 | Roggero et al. | 702/6 |
| 6,901,391 | B2 * | 5/2005 | Storm et al. | 706/16 |
| 7,058,617 | B1 | 6/2006 | Hartman et al. | |
| 2002/0072828 | A1 * | 6/2002 | Turner et al. | 700/269 |
| 2003/0014131 | A1 | 1/2003 | Havener et al. | |
| 2003/0018399 | A1 | 1/2003 | Havener et al. | |

FOREIGN PATENT DOCUMENTS

| | | |
|---|---|---|
| WO | WO/0048022 | 8/2000 |
| WO | WO/02099464 | 12/2002 |

OTHER PUBLICATIONS

James K. Dietrich, "Three-Phase Oil Relative Permeability Models," SPE 6044, Oct. 3, 1976 (pp. 1-12).

(Continued)

*Primary Examiner*—Hugh Jones
(74) *Attorney, Agent, or Firm*—Fletcher Yoder LLP; William R. Walbrun; John M. Miller

(57) ABSTRACT

System and method for parameterizing one or more steady-state models each having a plurality of model parameters for mapping model input to model output through a stored representation of an in-situ hydrocarbon reservoir. For each model, training data representing operation of the reservoir is provided including input values and target output values. A next input value(s) and next target output value are received from the training data. The model is parameterized with the input value(s) and target output value, and derivative constraints imposed to constrain relationships between the input value(s) and a resulting model output value, using an optimizer to perform constrained optimization on the parameters to satisfy an objective function subject to the derivative constraints. The receiving and parameterizing are performed iteratively, generating a parameterized model. Multiple models form an aggregate model of the system/process, which may be optimized to satisfy a second objective function subject to operational constraints.

62 Claims, 8 Drawing Sheets

Plan View of Production and Injection Wells in a Field, Pressure Model Pattern

OTHER PUBLICATIONS

McCormack, M. D. and R. Day, "How Artificial Intelligence Impacts E&P Productivity", *World Oil*, Oct. 1993, pp. 81-87.

E. Hartman, "Training Feedforward Neural Networks with Gain Constraints," *Neural Computation*, vol. 12, pp. 811-829, Apr. 2000.

B. J. Kuipers, C. Chiu, D. T. Dalle Molle & D. R. Throop. 1991. "Higher-order derivative constraints in qualitative simulation", *Artificial Intelligence* vol. 51, pp. 343-379.

David R. Anderson, Dennis J. Sweeney, and Thomas A. Williams, "An Introduction to Management Science: Quantitative Approaches to Decision Making", West Publishing Co., 1991.

Efraim Turban and Jack R. Meredith, "Fundamentals of Management Science," Third Edition, Business Publications, Inc., 1985.

Terje Loken and Jan Komorowski; "Rough Modeling—A Bottom-Up Approach to Model Construction"; International Journal of Applied Mathematics and Computer Science; 2001; pp. 675-690; vol. 11, No. 3.

Simon Hayking; "Neural Networks: A Comprehensive Foundation"; 1999; pp. 77, 171, 172, 234, 235, 277, 278; Prentice Hall.

H. Schwetlick and V. Kunert; "Spline smoothing under constraints on derivatives"; 1993; vol. 33, No. 33; pp. 512-528; BIT Numerical Mathematics.

A. Centilmen, T. Ertekin and A. S. Grader; "Applications of Neural Networks in Multiwell Field Development"; 1999; 1999 SPE Annual Technical Conference; pp. 1-11.

Virginia M. Johnson and Leah L. Rogers; "Applying soft computing methods to improve the computational tractability of a subsurface simulation-optimization problem"; 2001; Journal of Petroleum Science and Engineering; vol. 29; pp. 153-175.

* cited by examiner

Plan View of Production and Injection Wells in a Field, Pressure Model Pattern

MODELING IN-SITU RESERVOIRS WITH DERIVATIVE CONSTRAINTS

BACKGROUND OF THE INVENTION

1. Field of the Invention

The present invention generally relates to the fields of predictive modeling and hydrocarbon, e.g., oil and/or natural gas, production, and more particularly to parameterization of stead-state empirical models of in-situ hydrocarbon reservoirs with derivative constraints.

2. Description of the Related Art

Many systems or processes in science, engineering, and business are characterized by the fact that many different inter-related parameters contribute to the behavior of the system or process. It is often desirable to determine values or ranges of values for some or all of these parameters which correspond to beneficial behavior patterns of the system or process, such as productivity, profitability, efficiency, etc. However, the complexity of most real world systems generally precludes the possibility of arriving at such solutions analytically, i.e., in closed form. Therefore, many analysts have turned to predictive models and optimization techniques to characterize and derive solutions for these complex systems or processes.

Predictive models generally refer to any representation of a system or process which receives input data or parameters related to system or model attributes and/or external circumstances/environment and generates output indicating the behavior of the system or process under those parameters. In other words, the model or models may be used to predict behavior or trends based upon previously acquired data. There are many types of predictive models, including linear, non-linear, analytic, and empirical models, among others, several types of which are described in more detail below.

Optimization generally refers to a process whereby past (or synthesized) data related to a system or process are analyzed or used to select or determine optimal parameter sets for operation of the system or process. For example, the predictive models mentioned above may be used in an optimization process to test or characterize the behavior of the system or process under a wide variety of parameter values. The results of each test may be compared, and the parameter set or sets corresponding to the most beneficial outcomes or results may be selected for implementation in the actual system or process.

FIG. 1A illustrates a general optimization process as applied to an industrial process 104, such as a manufacturing plant, according to the prior art. It may be noted that the optimization techniques described with respect to the manufacturing plant are generally applicable to all manner of systems and processes.

As FIG. 1A shows, the operation of the process 104 generates information or data 106 which is typically analyzed and/or transformed into useful knowledge 108 regarding the system or process. For example, the information 106 produced by the process 104 may comprise raw production numbers for the plant which are used to generate knowledge 108, such as profit, revenue flow, inventory depth, etc. This knowledge 108 may then be analyzed in the light of various goals and objectives 112 and used to generate decisions 110 related to the operation of the system or process 104 subject to various goals and objectives 112 specified by the analyst. As used herein, an "objective" may include a goal or desired outcome of an optimization process. Example goals and objectives 112 may include profitability, schedules, inventory levels, cash flow, revenue growth, risk, or any other attribute which the user may wish to minimize or maximize. These goals and objectives 112 may be used to select from among the possible decisions 110, where the decisions may comprise various parameter values over which the user may exercise control. The selected decision(s) may then determine one or more actions 114 to be applied to the operation of the system or process 104. The subsequent operation of the system or process 104 then generates more information 106, from which further knowledge 108 may be generated, and so on in an iterative fashion. In this way, the operation of the process 104 may be "tuned" to perform in a manner which most closely meets the goals and objectives of the business or enterprise.

FIG. 1B illustrates an optimization system where a computer based optimization system 102 operates in conjunction with a process 104 to optimize the process, according to the prior art. In other words, the computer system 102 executes software programs (including computer based predictive models) which receive process data 106 from the process 104 and generate optimized decisions and/or actions which may then be applied to the process 104 to improve operations based on the goals and objectives.

Thus, many predictive systems may be characterized by the use of an internal model which represents a process or system 104 for which predictions are made. As mentioned above, predictive model types may be linear, non-linear, stochastic, or analytical, among others. However, for complex phenomena non-linear models may generally be preferred due to their ability to capture non-linear dependencies among various attributes of the phenomena. Examples of non-linear models may include neural networks and support vector machines (SVMs).

The types of models used in optimization systems include fundamental or analytic models which use known information about the process 104 to predict desired unknown information, such as product conditions and product properties. A fundamental model may be based on scientific and engineering principles. Such principles may include the conservation of material and energy, the equality of forces, and so on. These basic scientific and engineering principles may be expressed as equations which are solved mathematically or numerically, usually using a computer program. Once solved, these equations may give the desired prediction of unknown information.

Conventional computer fundamental models have significant limitations, such as:

(1) They may be difficult to create since the process may be described at the level of scientific understanding, which is usually very detailed;

(2) Not all processes are understood in basic engineering and scientific principles in a way that may be computer modeled;

(3) Some product properties may not be adequately described by the results of the computer fundamental models; and (4) The number of skilled computer model builders is limited, and the cost associated with building such models is thus quite high.

These problems result in computer fundamental models being practical only in some cases where measurement is difficult or impossible to achieve.

Empirical models, also referred to as computer-based statistical models, may also be used to model the system or process 104 in an optimization system. Such models typically use known information about process to determine desired information that may not be easily or effectively measured. A statistical empirical model may be based on the correlation of measurable process conditions or product properties of the process. Examples of computer-based empirical or statistical models include neural networks and support vector machines.

For one example of a use of a computer-based statistical model, assume that it is desired to be able to predict the color of a plastic product. This is very difficult to measure directly, and takes considerable time to perform. In order to build a computer-based statistical model which may produce this desired product property information, the model builder would need to have a base of experience, including known information and actual measurements of desired unknown information. For example, known information may include the temperature at which the plastic is processed. Actual measurements of desired unknown information may be the actual measurements of the color of the plastic.

A mathematical relationship (i.e., an equation) between the known information and the desired unknown information may be created by the developer of the empirical statistical model. The relationship may contain one or more parameters or constants (which may be assigned numerical values) which affect the value of the predicted information from any given known information. In an analytic model these parameters are referred to as coefficients. A computer program may use many different measurements of known information, with their corresponding actual measurements of desired unknown information, to adjust these constants so that the best possible prediction results may be achieved by the empirical statistical model. Such a computer program, for example, may use non-linear regression or any of various other techniques to determine the values of the parameters.

Computer-based statistical models may sometimes predict product properties which may not be well described by computer fundamental models. However, there may be significant problems associated with computer statistical models, which include the following:

(1) Computer statistical models require a good design of the model relationships (i.e., the equations) or the predictions may be poor;
(2) Statistical methods used to adjust the constants typically may be difficult to use;
(3) Good adjustment of the constants may not always be achieved in such statistical models; and
(4) As is the case with fundamental models, the number of skilled statistical model builders is limited, and thus the cost of creating and maintaining such statistical models is high.

Predictive model types also include procedural or recipe based models. These models typically comprise a number of steps whose performance emulates or models the phenomenon or process. Thus, procedural or recipe models are not based on understanding of the fundamental processes of a system, but instead, are generally constructed with an empirical or emulative approach.

Generally, a model is parameterized or trained with training data, e.g., historical or synthesized data, in order to reflect salient attributes and behaviors of the phenomena being modeled. In the parameterizing or training process, sets of training data may be provided as inputs to the model, and the model output may be compared to corresponding sets of desired outputs. The resulting error is often used to adjust weights or coefficients in the model until the model generates the correct output (within some error margin) for each set of training data. The model is considered to be in "training mode" during this process. After parameterization, the model may receive real-world data as inputs, and provide predictive output information which may be used to control or make decisions regarding the modeled phenomena.

Generally, to parameterize a predictive model, historical data are gathered, e.g., information generated by the system or process 104 in previous operations. The historical data are typically preprocessed to put the data into a form useful for creating, parameterizing, and/or training a predictive model. The predictive model is then created, parameterized, and/or trained. As mentioned above, the predictive model could be any of a variety of model types, depending upon the particular application and/or available resources. The model may then be analyzed. In other words, various tools may be applied to discover the behavior of the model. In response to this analysis, the model may be modified or tuned to more accurately represent the phenomenon, system, or process being modeled. Further historical data may then be used to further parameterize or train the model, and the model analyzed and modified to further refine the model behavior. This process may be performed iteratively until the model is parameterized or trained appropriately.

Finally, once the model has been parameterized or trained, the model may be deployed. For example, the model may be included in an optimization system 100 which is coupled to a real world process or system 104, as described above with reference to FIGS. 1A and 1B.

In one application of optimization techniques, predictive models may be used by a decision-maker associated with an operation or enterprise to select an optimal course of action or optimal course of decision. The optimal course of action or decision may include a sequence or combination or actions and/or decisions. For example, optimization may be used to select an optimal course of action for production of hydrocarbons, e.g., petroleum or oil, natural gas, etc., from a reservoir, such as determining when and where to drill wells, what pressures to maintain, and so forth.

As used herein, "decision variables" are those variables that the decision-maker may change to affect the outcome of the optimization process 100. For example, in the hydrocarbon reservoir example, pressure and injection flows may be decision variables. As used herein, "external variables" are those variables that are not under the control of the decision-maker. In other words, the external variables are not changed in the decision process but rather are taken as givens. For example, external variables may include variables such as hydrocarbon production or output.

FIG. 2 is a block diagram of a predictive model 215 as used in an optimization system 100, according to the prior art. As FIG. 2 shows, the model 215 may receive input in the form of external variables 212 and decision variables 214, defined above, and generate action variable 218. As used herein, "action variables" are those variables that propose or suggest a set of actions for an input set of decision and external variables. In other words, the action variables may comprise predictive metrics for a behavior. For example, in the optimization of a hydrocarbon production operation, the action variables may include the productivity of an oil or gas well or group of wells.

Thus, predictive models may be used for analysis, control, and decision making in many areas, including hydrocarbon production, manufacturing, process control, plant management, quality control, optimized decision making, e-commerce, financial markets and systems, or any other field where predictive modeling may be useful.

FIGS. 3A and 3B illustrate a general optimization system and process using predictive models with an optimizer to generate optimal decision variables, according to the prior art.

FIG. 3A is a block diagram which illustrates an overview of optimization according to the prior art. As shown in FIG. 3A, an optimization process 100 may accept the following elements as input: information 302, such as oil well or reservoir conditions, predictive model(s) such as hydrocarbon reservoir or well model(s) 304, and one or more constraints and/or objectives 306, such as injection rates, mass balances, and desired production rates or profitability. As used herein, a "constraint" may include a limitation on the outcome of an optimization process. Constraints are typically "real-world" limits on the decision variables and are often critical to the feasibility of any optimization solution. Managers who control resources and capital or are responsible for financial effects or results may be involved in setting constraints that accurately represent their real-world environments. Setting constraints with management input may realistically restrict the allowable values for the decision variables. The optimization process 100 may produce as output an optimized set of decision variables 312. In a hydrocarbon reservoir example, each of the predictive model(s) 304 may be an oil or gas well model, and may correspond to a different well 302.

FIG. 3B illustrates data flow in the optimization system of FIG. 3A. As FIG. 3B shows, the information 202 typically includes decision variables 214 and external variables 212, as described above. The information 302, including decision variables 214 and external variables 212, is input into the predictive model(s) 304 to generate the action variables 218. In this example, each of the predictive model(s) 304 may correspond to one of the oil or reservoir conditions 302, where each of the conditions 302 includes appropriate decision variables 214 and external variables 212. As mentioned above, the predictive model(s) 304 may include well or reservoir model(s) as well as other models. The predictive model(s) 304 can generally take any of several forms, as described above, including trained neural nets, statistical models, analytic models, and any other suitable models for generating predictive metrics, and may take various forms including linear or non-linear, or may be derived from empirical data or from managerial judgment.

As FIG. 3B shows, the action variables 218 generated by the model(s) 304 are used to formulate constraint(s) and the objective function 306 via formulas. For example, a data calculator 320 generates the constraint(s) and objective 306 using the action variables 218 and potentially other data and variables. The formulations of the constraint(s) and objective 306 may include financial formulas such as formulas for determining net operating income over a certain time period. The constraint(s) and objective 306 may be input into an optimizer 324, which may comprise, for example, a custom-designed process or a commercially available "off the shelf" product. The optimizer may then generate the optimal decision variables 312 which have values optimized for the goal specified by the objective function and subject to the constraint(s) 306. A further understanding of the optimization process 100 may be gained from the references "An Introduction to Management Science: Quantitative Approaches to Decision Making", by David R. Anderson, Dennis J. Sweeney, and Thomas A. Mayiams, West Publishing Co. (1991); and "Fundamentals of Management Science" by Efraim Turban and Jack R. Meredith, Business Publications, Inc. (1988).

In many applications, such as, for example, hydrocarbon production, prior approaches to predictive modeling have involved extremely complex models that require large amounts of data. A primary drawback to these models is that they may require significant computational resources and may take a great deal of time to run, e.g., days to weeks. Additionally, the requirement for large amounts of data may be problematic in that in many cases the data may be unavailable or unreliable. A typical reservoir engineering problem is to determine the injection rates that maximize field production. A rigorous simulation model is typically fit to field data in what is known as a "history match". In prior art approaches, a man-year or more may be spent parameterizing or tuning the model so that it replicates what the oil field has done historically. After a large fraction of the project budget is used up, e.g., 85%, the reservoir engineers typically make 15 or 20 runs of the simulation and then make their best guess for the injection rates.

Therefore, improved systems and methods for parameterizing or training steady-state models of in-situ reservoirs are desired.

SUMMARY OF THE INVENTION

The present invention comprises various embodiments of a system and method for parameterizing steady-state models using derivative constraints. More specifically, embodiments of a system and method are described for parameterization of a compact empirical model of an in-situ hydrocarbon reservoir using derivative constraints and an optimizer. The model preferably has a plurality of model parameters or coefficients $p=p_0 \ldots p_n$ for mapping model input to model output through a stored representation of the reservoir, where the term "system" may also refer to a process or operations related to the reservoir. Thus, in an exemplary application of the techniques described, the model may represent an in-situ hydrocarbon reservoir and/or operations related to hydrocarbon production from the reservoir, although the methods described herein are broadly applicable in other fields and domains as well, such as, for example, engineering petroleum or natural gas production, chemical processing, e-commerce, finance, stock analysis, and manufacturing, among others.

In one embodiment, a training data set may be provided, where the training data set includes a plurality of input values u and a plurality of target output values y. The training data set is preferably representative of the operation of the system, e.g., the hydrocarbon reservoir. In one embodiment, the training data set may include historical data, e.g., input and output data from past operation and/or measurements of the system, and/or synthesized data. For example, in the hydrocarbon reservoir application, the input values u may represent injection rates and/or injection cell pressures for injection wells in the reservoir, and the target output values y may represent production rates for production wells of the reservoir.

A next at least one input value $u_i$ of the plurality of input values u and a next target output value $y_i$ of the plurality of target output values y may be received. In other words, the method may select a next set of input/output values from the training data set for use in parameterizing the model. Note that a distinction is made between target outputs of the model, represented by y, and actual model outputs, represented herein by the term $\hat{y}_i$, e.g., y-hat$_i$ or y-caret$_i$.

Once the input and target output values have been received, an optimizer may be used to parameterize the model with a predetermined algorithm using $u_i$, $y_i$, and one or more derivative constraints. Note that $u_i$ may comprise one or more input values. The one or more derivative constraints are preferably imposed to constrain relationships between the input value(s) $u_i$ and a resulting model output value $\hat{y}_i$. In other words, parameterizing the model may include using an optimizer to perform constrained optimization on the plurality of model parameters to satisfy an objective function (p subject to the derivative constraints.

In one embodiment, the objective function may include minimizing an error between the model output value $\hat{y}_i$ (resulting from input value $u_i$) and the target output value $y_i$. In other words, the objective function may be defined for each input value/target output value pair, and the optimizer used to determine parameters (coefficients) for the model that minimize the error subject to the derivative constraints.

For example, as is well known in the art, a first input value $u_0$ may be input to the model, where the model is characterized by initial parameter values $p_0$, resulting in a first model output value $\hat{y}_0$. A first error $e_0=y_0-\hat{y}_0$ may be computed that represents the difference between the actual model output and the target model output. In other words, the error indicates the degree to which the model does not display the target behavior, e.g., the degree to which the model coefficients are incorrect. In one embodiment, the objective function may have the following form: $\phi_{min}=e_i^2$. In other words, the objective function aims to minimize the error squared for each value pair. The optimizer may operate to perturb the initial parameters $p_0$, e.g., by $\Delta p_0$, to generate a new set of parameters $p_1=p_0+\Delta p_0$. A second at least one input value $u_i$ may then be input to the model, where the model is now characterized by the new parameter values $p_1$, resulting in a second model output value $\hat{y}_1$. A second error $e_1=y_1-\hat{y}_1$ may be computed that represents the difference between the second model output value and a second target model output $y_1$. Now, the expression $\Delta e_0=(e_1-e_0)$ indicates the sensitivity of the error to perturbations in the parameters, and thus may be used to compute a slope $m_0=\Delta e_0/\Delta p_0$ for the error. This computed slope may then be used to increment $p_1$, e.g., to compute $\Delta p_1$, giving $p_2$, and so on, where the calculation of each $\Delta p_i$ is performed subject to the derivative constraints. This process may be repeated until the parameters converge, i.e., until the model output substantially matches the target output. It is noted that in this embodiment, over the course of the optimization process, the objective function $\phi_{min}=\Sigma e_i^2$, i.e., comprises a least squares minimization.

In one embodiment, each set of model input/output values $u_i/y_i$ from the training set comprises data for the system or process at a respective time. Thus, the set of training data u/y may comprise system or process data spanning a specified duration, e.g., 6 months of logged hydrocarbon reservoir data.

In a preferred embodiment, the model includes a model function, and the one or more derivative constraints include upper and/or lower bounds on one or more model function derivatives. In other words, in a preferred embodiment, the one or more derivative constraints may include estimated allowable ranges for one or more derivatives of the model function. The one or more model function derivatives may include one or more of: a first order derivative of the model function, a second order derivative of the model function, and a third order derivative of the model function. In other embodiments, the one or more model function derivatives also include one or more fourth or higher order derivatives of the model function. In one embodiment, the one or more model function derivatives may include a zeroth or higher order derivative of the model function, where the zeroth order derivative refers to the model function itself. In other words, the model function itself may be a constraint, for example, by enforcing the relationships between the input values $u_i$ and the target output values $y_i$, although in some embodiments, this constraint may be imposed implicitly or as a consequence of the optimization process.

In one embodiment, at least one of the upper and/or lower bounds may be a constant. In another embodiment, at least one of the upper and/or lower bounds may be a function. In a preferred embodiment, the model function has no cross-terms, with the result that the derivatives of the model function have no cross-terms, although in other embodiments, cross-terms may be allowed, and thus the derivatives of the model function may also have cross-terms. In one embodiment, the model function may comprise a dimensionless group, i.e., may comprise one or more ratios wherein the dimensions or units cancel, thereby generating dimensionless values, as is well known in dimensional analysis. In one embodiment, one or more of the model function derivatives may also comprise dimensionless groups.

A determination may then be made as to whether the model parameters have converged, e.g., whether the model has converged, and if not, then the method may proceed as described above, where a next at least one input value $u_{i+1}$/target output value $y_{i+1}$ may be selected, and the process repeated. In other words, the receiving and parameterizing using the optimizer may be performed iteratively to generate a parameterized model. Thus, in one embodiment, the parameterization process may be iteratively performed to determine parameters in a rigorous simulation model. In one embodiment, the receiving and parameterizing for each at least one input value $u_i$ and each target output value $y_i$ of the training data set may be performed two or more times. In another embodiment, the receiving and parameterizing for each at least one input value $u_i$ and each target output value $y_i$ of the training data set may be performed until the model parameters converge. Thus, parameterization may be performed using an optimization algorithm that allows inequality constraints on functions of the model parameters or variables.

In a preferred embodiment, the model may be a multiple input-single output (MISO) model, where the model function accepts a vector of input values, e.g., $u_i$ and generates a single output value $y_i$. It is further noted that in a preferred embodiment, a plurality of MISO models may be used to model the system or process, where the set of MISO models compose an aggregate model of the system or process. Thus, the providing, receiving, parameterizing, and iteratively performing described above may be performed for each of a plurality of models, wherein the plurality of models compose an aggregate model of the system. Additionally, each of the plurality of models has a respective model function, where each model function (as well as the derivatives of the function) preferably has no cross-terms, although embodiments with cross-terms are also contemplated. As noted above, one or more of the model functions may optionally comprise a dimensionless group. Similarly, one or more of each model function's derivatives may also comprise dimensionless groups. Each MISO model may represent a respective aspect of the system or process. For example, in the hydrocarbon reservoir example, each injection well and/or each production well, may have an associated MISO model, or even multiple MISO models, representing the behavior of that respective well.

Thus, applying the method described above to each of the plurality of models may include: providing a training data set comprising a plurality of input values u and a plurality of target output values y for each of said plurality of models may include providing a training data set comprising a plurality of input vectors u and a plurality of target output vectors y, where each input vector $u_i$ includes respective one or more input values for each of the plurality of models, and thus each input vector $u_i$ is an input vector for the aggregate model. Similarly, each target output vector y may include respective target output values for each of the plurality of models, where each target output vector y is a target output vector for the aggregate model. Finally, for each input vector $u_i$, the aggregate model may operate to generate a resulting model output vector $\hat{y}_i$, comprising respective output values for each of the plurality of models. Thus, various embodiments of the method may be applied to parameterize an aggregate model of the system or process. The resulting parameterized model (the single MISO model and/or the aggregate model) may then be stored in a memory medium, and may be usable to analyze the system. For example, the model may be optimized to determine operational parameters of the system for optimal performance of the system, as described below.

In an alternate embodiment, the model may be a single input-single output (SISO) model, where the model function accepts a single input value, e.g., u and generates a single output value y. For example, in one embodiment of the in-situ hydrocarbon reservoir application, a two input model that takes x and y position values as inputs and generates a production value as output may be re-cast as a SISO model, where, for example, x is held constant, i.e., used as a model constant, and the model parameterized to find an optimal value of the now single input y. In one embodiment, a plurality of SISO models may be used to model the system or process, where the set of SISO models compose an aggregate model of the system or process. Each SISO model may represent a respective aspect of the system or process. For example, in the hydrocarbon reservoir example, each injection well and/or each production well, may have an associated SISO model, or even multiple SISO models, representing the behavior of that respective well. As described above, the one or more SISO models may be parameterized, and optionally optimized for optimal performance of the system or process.

Various embodiments also include a method for generating and using the parameterized model produced above. For example, a first objective function and derivative constraints may be determined for the system model, as was described in detail above. Then, constrained optimization may be performed with an optimizer on the model parameters to parameterize the model (satisfy the first objective function) subject to the derivative constraints, as described in detail above.

In one embodiment, once the model has been parameterized, then a second objective function may be determined, where the second objective function represents a desired behavior of the system. Additionally, operational constraints may optionally be determined that reflect bounds or limitations on the operation or behavior of the system. For example, in one embodiment, the second objective function may be to maximize profits, which in the in-situ reservoir example, may be related to the difference between the cost of the injected materials and the value of the hydrocarbon products produced. The operational constraints may include mass balancing, injection pressure limits, and so forth.

Once the second objective function and operational constraints are determined, then the optimizer and the parameterized model may be used to determine operation of the system that substantially satisfies the second objective function, optionally subject to the operational constraints. Said another way, the optimizer and the parameterized model may then be used to determine operational parameters for the system that attempt to satisfy the second objective function subject to the operational constraints, as is well known in the art. For example, in one embodiment, using the optimizer and the parameterized model to determine operation of the system may include determining one or more operational inputs for the system, where the one or more operational inputs and one or more resulting operational outputs for the system substantially satisfy the second objective function. In one embodiment, operational constraints may be imposed during the optimization process such that the determined operation of the system substantially satisfies the second objective function subject to one or more operational constraints. For example, in the hydrocarbon reservoir example, the optimizer may be used to determine injection rates and/or injection cell pressures for the injection wells that maximize profits, e.g., by maximizing oil production, subject to operational constraints on the system.

Finally, the system may be operated in accordance with the determined operational parameters to achieve desired goals. In other words, the optimal operational parameters determined with the optimizer and the parameterized model may be used to operate the system. In one embodiment, this may include executing the optimized (and parameterized) model using input data related to operating conditions of the system to determine the operational parameters needed to produce the desired results, then operating the system using the operational parameters. Said another way, once the model has been parameterized and optionally optimized with respect to a desired objective, the parameterized model may be executed to generate resultant data, and the system may be operated in accordance with the resultant data to achieve desired results. In other words, the parameterized model may be executed on a computer to generate data which may be used to operate the system in a substantially optimal manner.

Thus, in the case where the system includes an in-situ hydrocarbon reservoir, the model may represent operations related to production of the hydrocarbon, e.g., oil or gas, from the reservoir. For example, in the hydrocarbon reservoir example from above, the injection wells of the reservoir may be operated using the determined injection rates and/or injection cell pressures that may result in increased oil production and/or profitability. Thus, various embodiments of the above method may be used to determine operation of the system that substantially satisfies the second objective function subject to one or more operational constraints, i.e., to determine operational parameters for the system for various goals.

For example, in various embodiments, the optimizer and the parameterized model may be used to determine a combination of injection rates that maximizes production within constraints of injection rate and injector cell pressure, to determine operation of the system for secondary and/or tertiary recovery, to determine one or more completion depths for one or more wells, to determine one or more locations for drilling or shutting in wells, and to determine one or more rates of stimulant injection to maximize production, among others.

Thus, derivative-constrained parameterization (DCP) may provide several advantages over current predictive modeling techniques used in a wide variety of applications, e.g., hydrocarbon reservoir engineering, etc., including, for example, 1) a rigorous simulation model may not be required in that a compact empirical model with derivative constraints may accurately capture salient aspects of the system behavior; 2) the data required already exists, i.e., data requirements for using the compact empirical model with derivative constraints are substantially less (e.g., perhaps by a factor of 100) than most prior art approaches, and in many cases the required information is readily available, e.g., from reservoir well inspections (e.g., pressures and flows), engineering data and knowledge (e.g., permeability plots), etc.; 3) engineering the model may take weeks instead of months, due to the simplicity of the model and its reduced data requirements; and finally, 4) the derivatives constraints are intuitive. In other words, in general, e.g., in the hydrocarbon reservoir example, the derivative constraints and behaviors represent easily understood phenomena related to the modeled system, and thus may generally be specified in a relatively straightforward manner. For example, as noted above, the first derivatives are known as inter-well transmissibilities and production indices. The second derivatives indicate how much curvature is allowed, and the third derivatives indicate how fast the curvature can change. After some experience with this method a reservoir engineer may become accustomed to adding information in these terms and accurate models may result.

Thus, optimization techniques may be used to both parameterize the system model(s), i.e., by optimizing the model parameters to fit the training data subject to derivative constraints, and to optimize operation of the modeled system, e.g., the in-situ hydrocarbon reservoir, i.e., by optimizing operational system parameters, e.g., to meet a production or business objective. Although it should be noted that the two optimization processes are preferably separate and distinct from one another.

BRIEF DESCRIPTION OF THE DRAWINGS

A better understanding of the present invention can be obtained when the following detailed description of the preferred embodiment is considered in conjunction with the following drawings, in which.

Figure 1A:
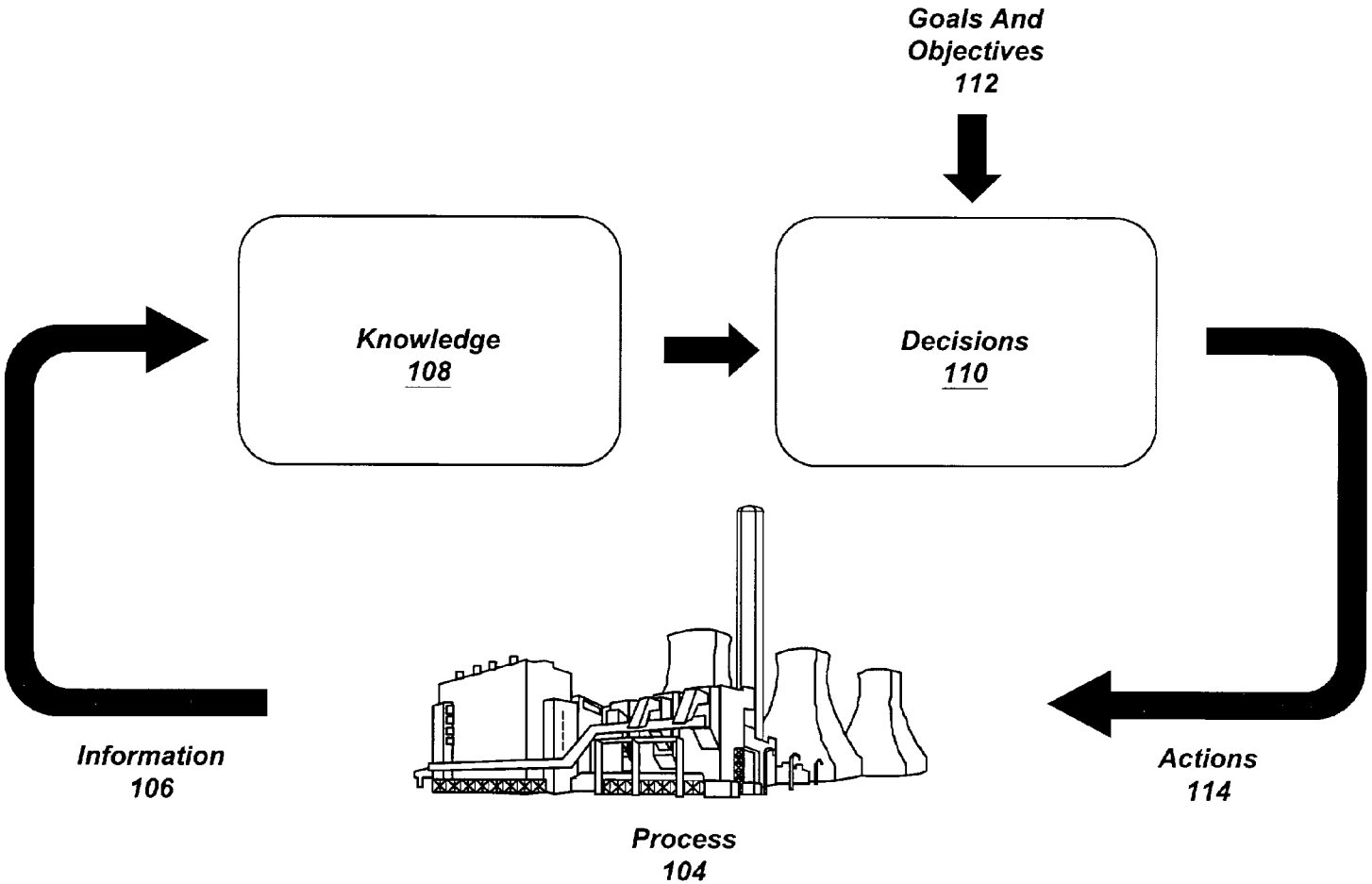
Figure 1A (Prior Art)
FIG. 1A illustrates a general optimization process as applied to an industrial process 104, such as a manufacturing plant, according to the prior art.
Figure 1B:
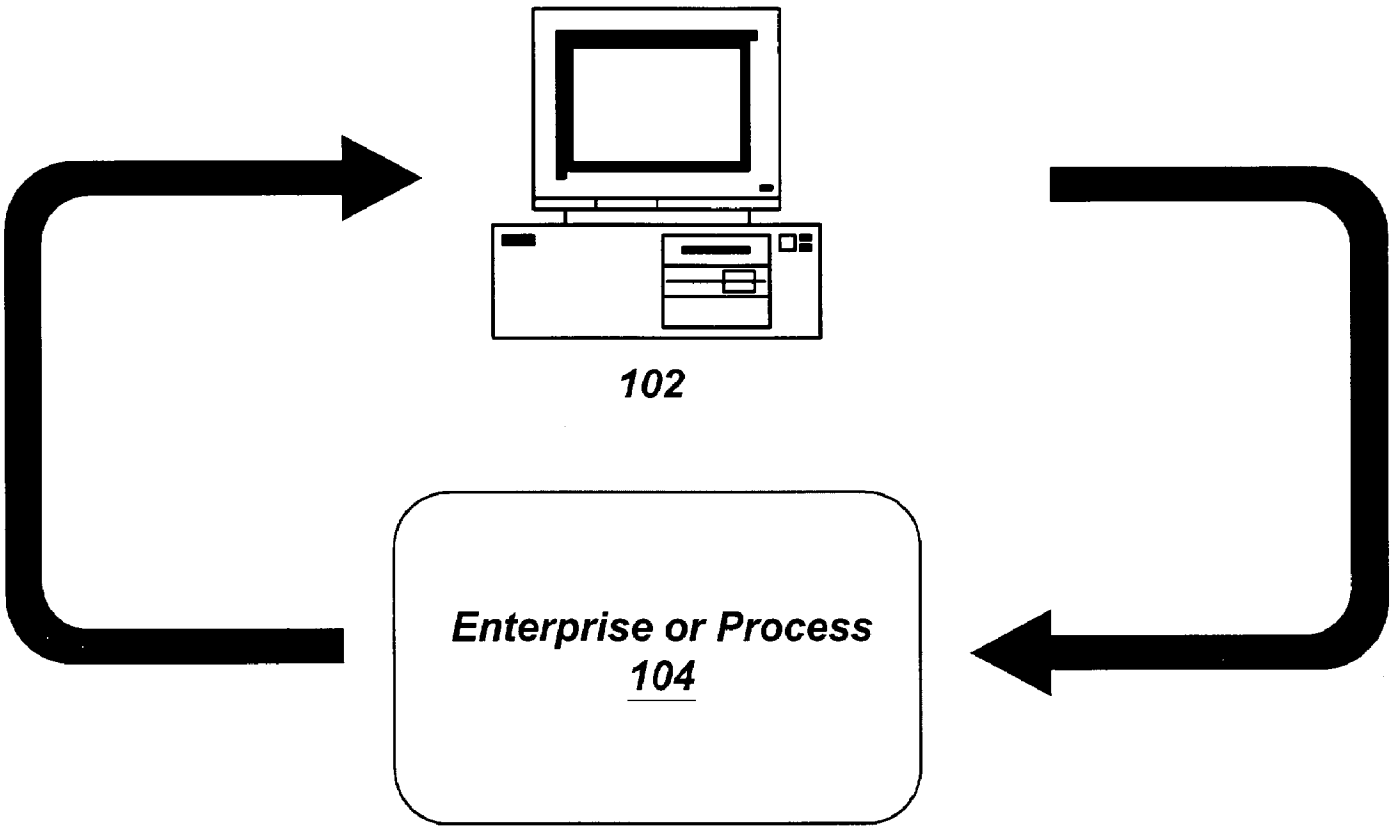
Figure 1B (Prior Art)
FIG. 1B illustrates an optimization system where a computer based optimization system 102 operates in conjunction with a process 104 to optimize the process, according to the prior art.
Figure 2:
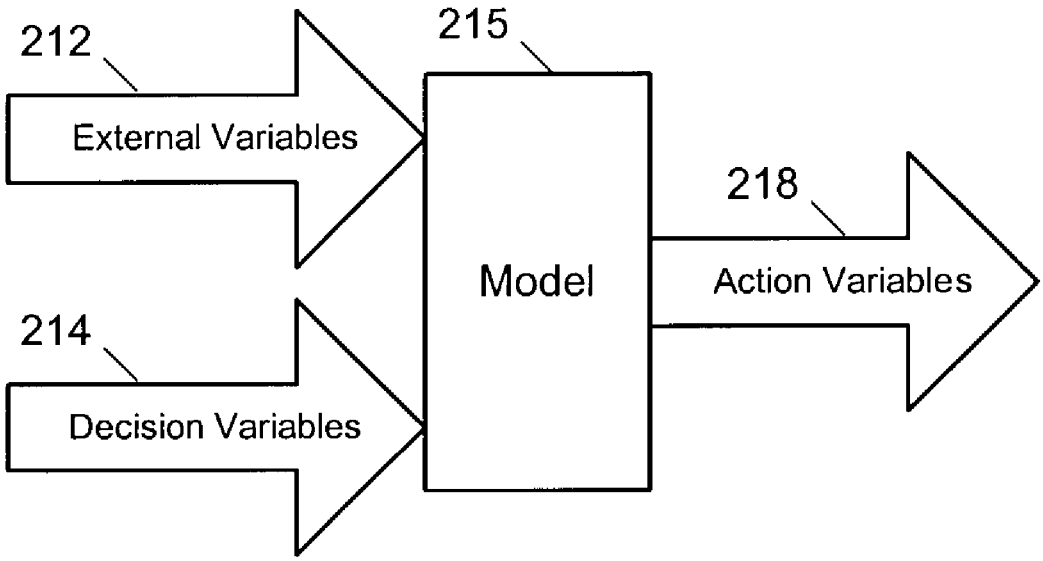
Figure 2 (Prior Art)
FIG. 2 is a block diagram of a predictive model 215 as used in an optimization system 100, according to the prior art.
Figure 3A:
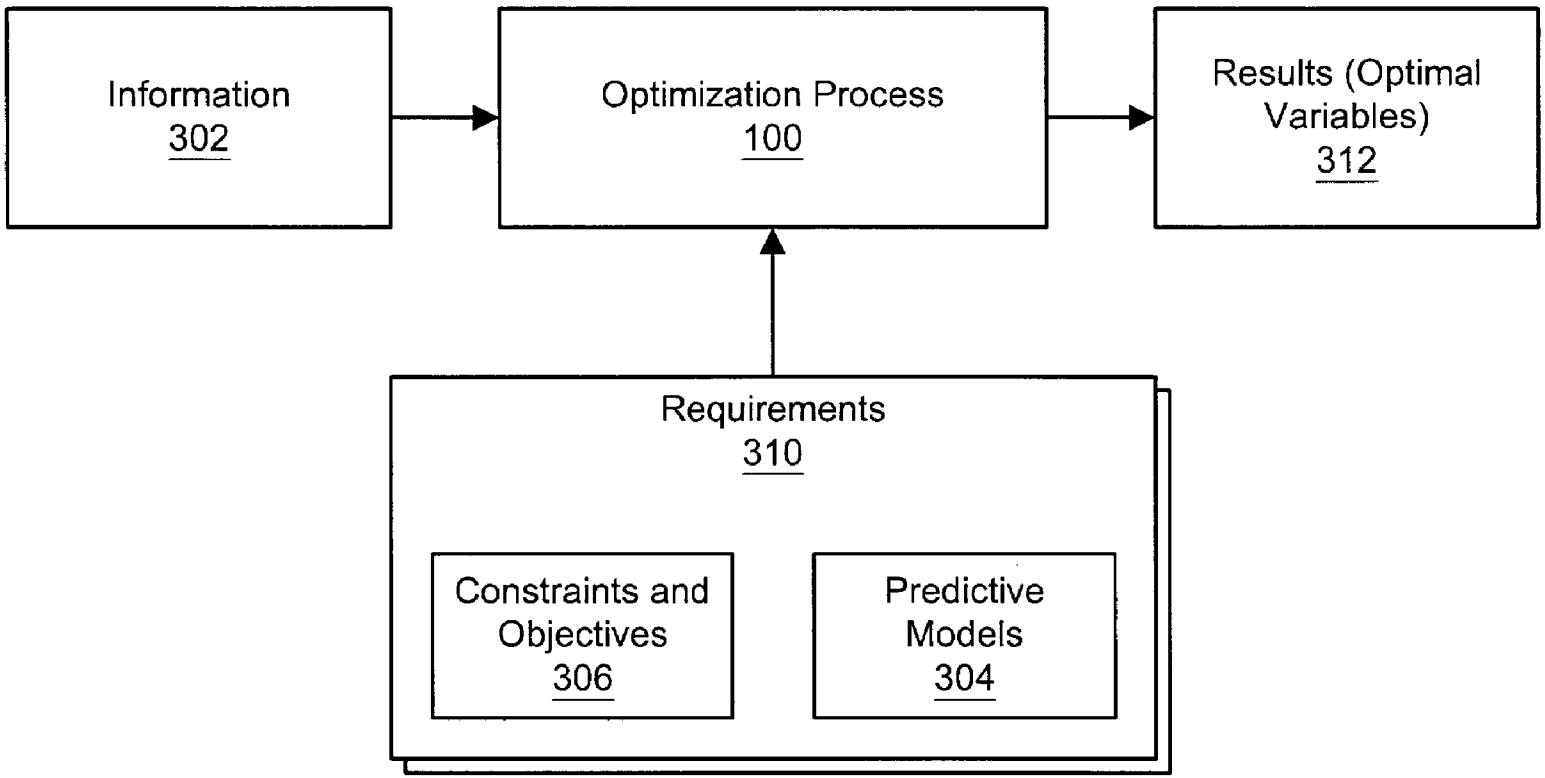
Figure 3A (Prior Art)
FIGS. 3A and 3B illustrate a general optimization system and process using predictive models with an optimizer to generate optimal decision variables, according to the prior art.
Figure 3B:
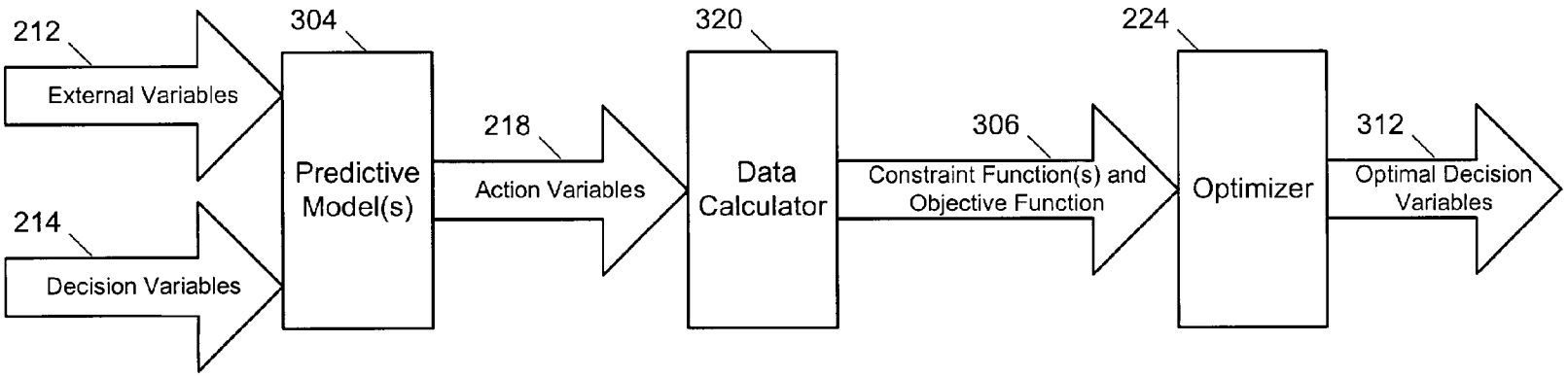
Figure 3B (Prior Art)

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE EMBODIMENTS

Figure 4:
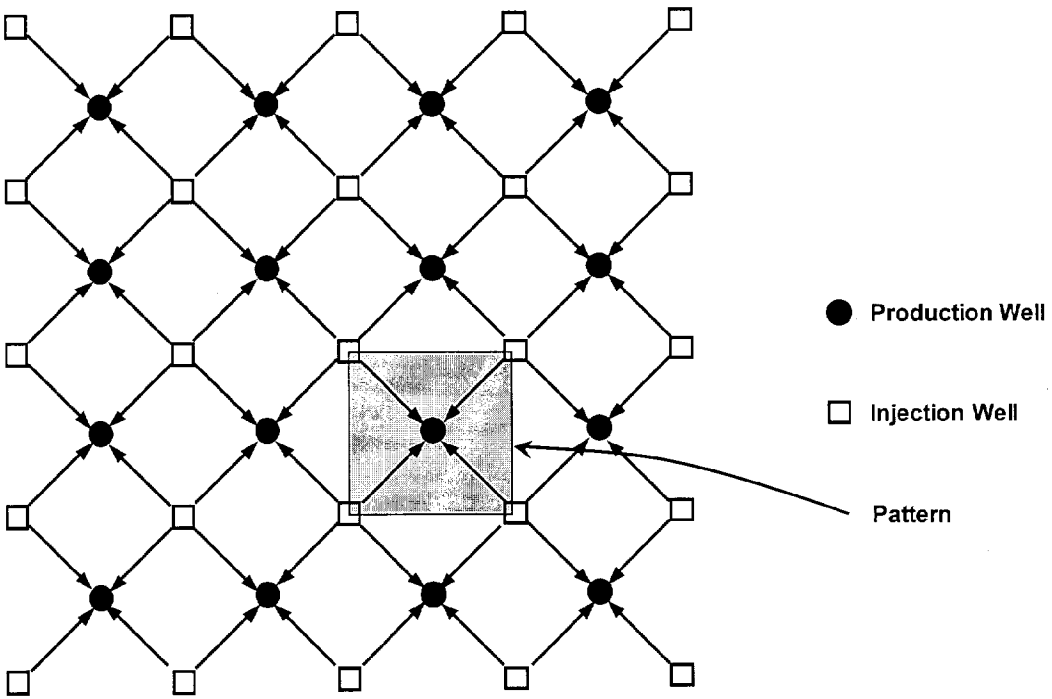
FIG. 4 is a plan view of production and injection wells in a field, according to one embodiment.

FIG. 4—Hydrocarbon Reservoir Modeling

As was noted above, in many fields predictive models are used to optimize operations and processes, where generally the model is first parameterized or trained based on a set of training data, then used with an optimizer to determine optimal operating approaches or processes. However, as also noted above, in many prior art approaches the models are extremely complex, requiring long run-times and/or require large amounts of data, which in many cases may not be readily available or which may be difficult or expensive to obtain.

For example, in the field of hydrocarbon production, simulation (modeling) of reservoir performance (numerical simulation) has become the pre-eminent tool for forecasting and decision making in the hydrocarbon industry. The simulations are used to estimate current operations, predict future production results, and study "play" options for production improvements. Use of reservoir simulators becomes more important as production moves from primary to secondary and tertiary stages as the incremental margins decrease and accurate predictions of considered or proposed strategies or operations become more critical to profitability.

FIG. 4 is an illustration of a simplified oil field pressure model pattern. More specifically, FIG. 4 illustrates a plan view of production and injection wells in a field with the pressure model pattern for each well shown. Injection wells and production wells are laid out in different patterns, depending on the geological situation of the field. A common pattern is the "five spot" pattern shown in FIG. 4. As is well known in the art, injection wells, represented in FIG. 4 as white squares may be interspersed among production wells, represented as filled circles, and may be used to inject water and/or other materials into a reservoir to control and maintain reservoir pressure. This pressure may in turn result in increased production or production of hydrocarbon from the production wells. This phenomenon is illustrated by arrows or vectors denoting pressure emanating from the injections wells and converging on the production wells, as exemplified by the pattern in the large grayed region.

In an oil field, oil, water, and gas are produced from wells by the natural pressure resulting from the overlying rocks. The pressure declines as more and more fluids are taken from the reservoir, and it is common practice to re-inject pressurized water and gas back into the reservoir to maintain pressure. A key responsibility of a reservoir engineer is to develop a comprehensive picture of the flow of produced and injected fluids in the reservoir so that the maximum volumes of hydrocarbons can be recovered.

Factors that contribute to the actual behavior of the reservoir under a particular injection/production well pattern and injection process include geological attributes such as permeability (porosity) or transmissibility, temperature, and pressure of the reservoir medium, e.g., rock, sandstone, shale, etc., as well as properties of the oil, e.g., viscosity, etc. A parameterized reservoir model attempts to capture the relationships among these attributes, allowing prediction of reservoir behavior under specified operations or conditions. Given a parameterized model of the reservoir, various operational strategies and tactics may be explored or analyzed, e.g., by using an optimizer, to determine optimal operations with respect to profit or other objective.

Compact Empirical Models

Various embodiments of the present invention relate to the parameterization and use of compact empirical models. A key feature of these compact empirical models is that they may be parameterized by a relatively small set of parameters as compared to most predictive models, e.g., by less than 5 parameters. Hence a 3rd order polynomial is an example of a compact empirical model. For example, consider an analytic model of the form:

$$y=au^3+bu^2+cu+d \tag{1}$$

where u is an input and y is a resulting output. In this case, parameterizing the model with training data involves determining values for coefficients a, b, c, and d, such that a given training input u produces the given training output y. Thus, each model may comprise a model function. It should be noted that the model of equation (1) is meant to be exemplary only, and is not intended to limit the particular form or order of the models considered herein.

A relatively simple analytic model such as equation (1) provides a number of advantages over prior art complex models, including speed of computation and understandability of the functional form. However, a possible disadvantage of such a model is its simplicity. In other words, in prior art approaches, such models have typically been unable to capture the salient behaviors of the phenomenon being modeled. This issue is addressed by various embodiments of the present invention in a manner that utilizes the simplicity of the model as a strength, as described below.

A primary benefit of a simple analytic model such as equation (1) is that derivatives of the function may be determined in a straightforward manner. As is well known, the derivatives (of various orders) of a function may provide additional insight as to the behavior of the function. For example, the first derivative of equation (1) is:

$$y'=3au^2+2bu+c \tag{2}$$

where the value of y' for a given u is the slope of the original function at that value of u.

Similarly, the second derivative of equation (1) is:

$$y''=6au+2b \tag{3}$$

where the value of y" for a given u indicates the curvature of the original function at that value of u.

Finally, the third derivative of equation (1) is:

$$y'''=6a \tag{4}$$

where the value of y''', in this case a constant, indicates the rate of change of curvature of the original function.

Thus, equations (2)-(4) above may provide additional representations of model behavior, e.g., of the behavior of equation (1). Additionally, readily available engineering expertise, e.g., knowledge and intuition, may be used to impose constraints on these derivatives, referred to herein as "derivative constraints," which may enable the parameterization of the model to be accomplished with very little data, e.g., 5 or 6 data points. In effect, a substantial portion of the model information is in the constraints, and thus, imposing constraints on the model derivatives provides another means for constraining model behavior, and thus may be used to parameterize the model. Said another way, the compact structure of the model allows constraints to be explicitly enforced on the derivatives of these models during parameterization. By introducing constraints into the derivatives, the model shapes in the derivative space can be guaranteed to incorporate engineering knowledge and scientific reality. A significant advantage of this approach is that it results in more accurate models, but most important is that the resulting empirical models can be parameterized with only a few data points, e.g., 5 or 6 data points.

Thus, in one embodiment, derivatives of one or more orders of the model function may be determined, and constraints imposed on these derivatives to parameterize the model, i.e., to determine values of the coefficients of the model. In one embodiment, the derivative constraints may take the form of upper and lower inequality constraints for each of the derivatives. For example, for the example model equation and derivatives above, the derivative constraints may be:

$$\min_1 <= y'=3au^2+2bu+c <= \max_1$$

$$\min_2 <= y''=6au+2b <= \max_2$$

$$\min_3 <= y'=6a <= \max_3 \tag{5}$$

where each min value establishes a hard constraint on the lower bound of the respective function, and each max value establishes a hard constraint on the upper bound of the respective function. Thus, the set of constraints (5) may define bounding surfaces for model behavior. In a preferred embodiment, the min and max values may be constants. In one embodiment, the min and max values for a given function may be set to the same value, thereby forcing the value of the function itself to be constant.

It is noted that in one embodiment, the model may be a single input-single output (SISO) model, where the model function accepts a single input value, e.g., u and generates a single output value y, as is the case in equation (1). It is further noted that in one embodiment, a plurality of SISO models may be used to model the system or process, where the set of SISO models compose an aggregate model of the system or process. Thus, following the above example, for each SISO model there are 6 derivative constraints (upper and lower bounds on each of the three derivatives), and so for 6 data points ($u_i$ and $y_i$), there are a total of 36 constraints with 24 functions, namely the model function and its derivative functions for each datum. As mentioned above, it should be noted that the example model functions and constraints given above are only for example, and that any other model equations and derivative constraints may be used as desired.

For example, in another embodiment, rather than constants, the min and max values for the derivative constraints may be given by functional expressions, i.e., the upper and lower bounds for the derivative functions may themselves be functions. In a preferred embodiment, each respective model function has no cross-terms, with the result that none of the derivatives of the model functions have no cross-terms. In another embodiment, each respective model function comprises a dimensionless group, as is well known from dimensional analysis.

The above example relates to SISO models and their constraints, which may be useful for many applications. However, in most real-world applications, such as modeling of in-situ hydrocarbon reservoirs, the models are multiple input-single output (MISO) models, where the model function accepts a vector of input values, e.g., $u_i$ and generates a single output value $y_i$. Thus, in a preferred embodiment, the model comprises a MISO model. It is further noted that in a preferred embodiment, a plurality of MISO models may be used to model the system or process, where the set of MISO models compose an aggregate model of the system or process. Additionally, as described above with respect to SISO embodiments, each of the plurality of models has a respective model function, where each model function (as well as the derivatives of the function) preferably has no cross-terms, although embodiments with cross-terms are also contemplated. As also noted above, one or more of the model functions may optionally comprise a dimensionless group. Similarly, one or more of each model function's derivatives may also comprise dimensionless groups. Each MISO model may represent a respective aspect of the system or process. For example, in the hydrocarbon reservoir example, each injection well and/or each production well, may have an associated MISO model, or even multiple MISO models, representing the behavior of that respective well.

A MISO (2-inputs) model example corresponding to the $3^{rd}$ order SISO model of (1) may have the form:

$$y=au_1^3+bu_1^2+cu_1+eu_2^3+fu_2^2+gu_2+hu_i^2u_2+iu_1u_2^2+ju_1u_2+d \tag{6}$$

where $u_1$ and $u_2$ are inputs and y is a resulting output. In this case, parameterizing the model with training data involves determining values for coefficients a, b, c, d, e, f, g, h, i, and j, such that a given training input vector $u(u_1,u_2)$ produces the given training output y. Note that equation (6) includes cross-terms with coefficients h, i, and j. It should be noted that the MISO model of equation (6) is meant to be exemplary only, and is not intended to limit the particular form or order of the models considered herein.

Determining the derivatives of equation (6), although more complex than equation (1), is still relatively straightforward. For example, ignoring cross-derivatives, the first derivatives of equation (6) are:

$$\partial y/\partial u_1=3au_1^2+2bu_1+2hu_1u_2+iu_2^2+ju_2+c \quad (7)$$

and $$\partial y/\partial u_2=3eu_2^2+2fu_2+2iu_1u_2+hu_1^2+ju_1+g. \quad (8)$$

Similarly, the second derivatives of equation (6) are:

$$\partial^2 y/\partial u_1^2=6au_1+2b+2hu_2 \quad (9)$$

and $$\partial^2 y/\partial u_2^2=6eu_2+2f+2iu_1. \quad (10)$$

Finally, the third derivatives of equation (6) are:

$$\partial^3 y/\partial u_1^3=6a \quad (9)$$

and $$\partial^3 y/\partial u_2^3=6e. \quad (10)$$

Thus, similar to the SISO example above, equations (7)-(10) above may provide additional representations of model behavior, e.g., of the behavior of equation (6). As noted above, readily available engineering expertise, e.g., knowledge and intuition, may be used to impose derivative constraints which may enable the parameterization of the model to be accomplished with very little data.

Thus, as described above, in one embodiment, derivatives of one or more orders of the model function may be determined, and constraints imposed on these derivatives to parameterize the model, i.e., to determine values of the coefficients of the model. In an embodiment where the derivative constraints take the form of upper and lower inequality constraints for each of the derivatives, the derivative constraints for the model of equation (6) may be:

$$\min_{1,u1}<=\partial y/\partial u_1=3au_1^2+2bu_1+2hu_1u_2+iu_2^2+ju_2+c<=\max_{1,u1}$$

$$\min_{1,u2}<=\partial y/\partial u_2=3eu_2^2+2fu_2+2iu_1u_2+hu_1^2+ju_1+g<=\max_{1,u2}$$

$$\min_{2,u1}<=\partial^2 y/\delta u_1^2=6au_1+2b+2hu_2<=\max_{2,u1}$$

$$\min_{2,u2}<=\partial^2 y/\partial u_2^2=6eu_2+2f+2iu_1<=\max_{2,u2}$$

$$\min_{3,u1}<=\partial^3 y/\partial u_1^3=6a<=\max_{3,u1}$$

$$\min_{3,u2}<=\partial^3 y/\partial u_2^3=6e<=\max_{3,u2} \quad (11)$$

where each min value establishes a hard constraint on the lower bound of the respective function, and each max value establishes a hard constraint on the upper bound of the respective function. Thus, the set of constraints (11) may define bounding surfaces for MISO model behavior. As noted above, in a preferred embodiment, the min and max values may be constants.

Note that following the example of equation (6), for each MISO model there are 12 derivative constraints (upper and lower bounds on each of the six derivatives), and so for 6 data sets ($u_i$ and $y_i$), there are a total of 72 constraints with 42 functions, namely the model function and its derivative functions for each data set. As mentioned above, it should be noted that the example model functions and constraints given above are only for example, and that any other model equations and derivative constraints may be used as desired.

Referring back to the in-situ hydrocarbon reservoir example of FIG. 4, well inspections are normally performed once per month, and the results of these inspections (e.g., pressures and flows) in addition to some engineering data (e.g., permeability plots) may be used to describe the field in engineering terms. Engineering knowledge may also include constraints on injection flows and injector cell pressures, as well as sensitivities between wells and other performance "curvature" information. This type of information may be used to estimate the derivative constraints for the model. For example, engineering knowledge related to pressure superposition in space for the reservoir may include the observation that if at a point in a reservoir more than one well causes a pressure drop, then the net pressure drop is simply the summation of the individual effects. Other examples of engineering knowledge that can be used to formulate or estimate derivative constraints include the Darcy equation, which relates flow and pressure through a volume, thus accounting for permeability and viscosity, and mass balance relationships, e.g., the sum of the injected flows in the four quadrants must equal the total injected flow, among others.

It is well known that field behavior changes slowly, on the order of years rather than months. This implies that one can use inspection data for a few months to represent "snapshots" of what would result one month from the current conditions of the field. More specifically, in one embodiment, the injection rates at the start of the month may be paired with the production rates and injection cell pressures at the end of the month, and this pairing may comprise one "data point". Since the compact model is parameterized using known constraints on its derivatives, only 5 or 6 data points may be required for parameterization. In one embodiment, the same monthly well inspection information and other engineering data used to estimate derivative constraints may also be used to parameterize the compact empirical model, as described below in detail.

As is well known in the art, solving for the coefficients of such a system is generally not computationally feasible in closed form, and thus, in a preferred embodiment, an optimizer may be used to solve for the coefficients subject to the constraints, and to thereby parameterize the model. Further details of the model parameterization are provided below with reference to FIG. 5.

Figure 5:
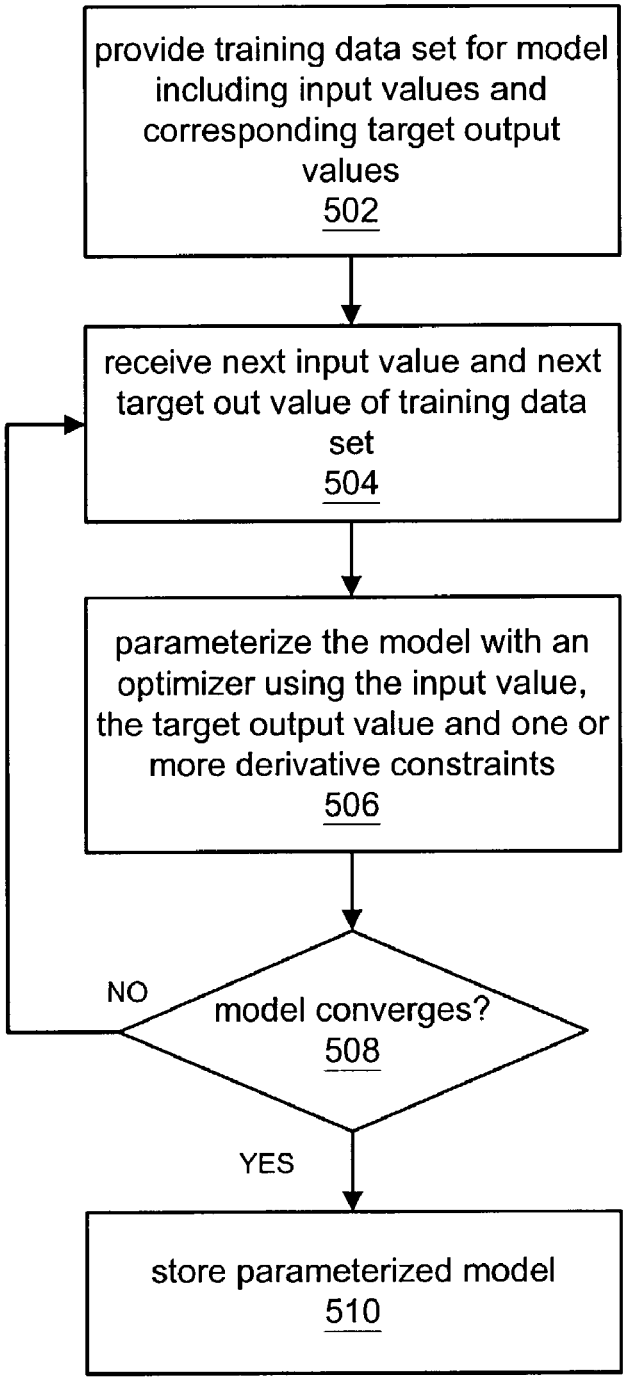
FIG. 5 flowcharts one embodiment of a method for parameterizing a predictive model.

FIG. 5—A Method for Parameterizing an Empirical Model

FIG. 5 flowcharts one embodiment of a method for parameterizing a steady state model. More specifically, the method of FIG. 5 relates to parameterization of a compact empirical model using derivative constraints and an optimizer. As noted above, the model preferably has a plurality of model parameters or coefficients $p=p_0 \ldots p_n$ for mapping model input to model output through a stored representation of a system, where the term system may also refer to a process. It is noted that the method described is exemplary, and that in various embodiments, two or more of the steps shown may be performed concurrently, in a different order than shown, or may be omitted. Additional steps may also be performed as desired.

In the below description of the method of FIG. 5, the in-situ hydrocarbon reservoir example of FIG. 4 is used to illustrates various portions of the method, although it is noted that the methods described herein are broadly applicable in other fields and domains, as well, such as, for example, engineering, hydrocarbon, e.g., oil or gas, production, chemical processing, e-commerce, finance, stock analysis, and manufacturing, among others. A typical reservoir engineering problem is to determine the injection rates that maximize field production. A rigorous simulation model is typically fit to field data in what is known as a "history match". In prior art approaches, a man-year or more may be spent parameterizing or tuning the model so that it replicates what the oil field has done historically. After a large fraction of the project budget is used up, e.g., 85%, the reservoir engineers typically make 15 or 20 runs of the simulation and then make their best guess for the injection rates. However, according to various embodiments of the present invention, the use of compact models may dramatically reduce the time needed to parameterize the model, as described in detail below.

As FIG. 5 shows, in 502, a training data set may be provided, where the training data set includes a plurality of input values or vectors u and a plurality of target output values y. As discussed above, the training data set is preferably representative of the operation of the system. In one embodiment, the training data set may include historical data, e.g., input and output data from past operation and/or measurements of the system, and/or synthesized data. For example, in the hydrocarbon reservoir application, the input values u may represent injection rates and/or injection cell pressures for injection wells in the reservoir, and the target output values y may represent production rates for production wells of the reservoir.

In 504, a next at least one input value $u_i$ of the plurality of input values u and a next target output value $y_i$ of the plurality of target output values y may be received, as indicated. In other words, the method may select a next set of input/output value pairs from the training data set for use in parameterizing the model. Note that a distinction is made between target outputs of the model, represented by y, and actual model outputs, represented herein by the term $\hat{y}_i$, e.g., y-hat$_i$ or y-caret$_i$.

Once the input and target output values have been received, then in 506, an optimizer may be used to parameterize the model with a predetermined algorithm using $u_i$, $y_i$, and one or more derivative constraints. The one or more derivative constraints are preferably imposed to constrain relationships between the at least one input value $u_i$ and a resulting model output value $\hat{y}_i$. In other words, parameterizing the model may include using an optimizer to perform constrained optimization on the plurality of model parameters to satisfy an objective function $\phi$ subject to the derivative constraints.

In one embodiment, the objective function may include minimizing an error between the model output value $\hat{y}_i$ (resulting from at least one input value $u_i$) and the target output value $y_i$. In other words, the objective function may be defined for each input value/target output value pair, and the optimizer used to determine parameters (coefficients) for the model that minimize the error subject to the derivative constraints.

For example, as is well known in the art, a first at least one input value $u_0$ may be input to the model, where the model is characterized by initial parameter values $p_0$, resulting in a first model output value $\hat{y}_0$. A first error $e_0=y_0-\hat{y}_0$ may be computed that represents the difference between the actual model output and the target model output. In other words, the error indicates the degree to which the model does not display the target behavior, e.g., the degree to which the model coefficients are incorrect. In one embodiment, the objective function may have the following form: $\phi_{min}=e_i^2$. In other words, the objective function aims to minimize the error squared for each value set. The optimizer may operate to perturb the initial parameters $p_0$, e.g., by $\Delta p_0$, to generate a new set of parameters $p_1=p_0+\Delta p_0$. A second at least one input value $u_1$ may then be input to the model, where the model is now characterized by the new parameter values $p_1$, resulting in a second model output value $\hat{y}_1$. A second error $e_1=y_1-\hat{y}_1$ may be computed that represents the difference between the second model output value and a second target model output $y_1$. Now, the expression $\Delta e_0=(e_1-e_0)$ indicates the sensitivity of the error to perturbations in the parameters, and thus may be used to compute a slope $m_0=\Delta e_0/\Delta p_0$ for the error. This computed slope may then be used to increment $p_1$, e.g., to compute $\Delta p_1$, giving $p_2$, and so on, where the calculation of each $\Delta p_i$ is performed subject to the derivative constraints. This process may be repeated until the parameters converge, i.e., until the model output substantially matches the target output. It is noted that in this embodiment, over the course of the optimization process, the objective function $\phi_{min}=\Sigma e_i^2$, i.e., comprises a least squares minimization.

In one embodiment, each set or pair of model input/output values, $u_i/y_i$ comprises data for the system or process at a respective time. Thus, the set of training data u/y may comprise system or process data spanning a specified duration, e.g., 6 months of logged hydrocarbon reservoir data.

As described above, in a preferred embodiment, the model includes a model function, and the one or more derivative constraints include upper and/or lower bounds on one or more model function derivatives. In other words, in a preferred embodiment, the one or more derivative constraints may include estimated allowable ranges for one or more derivatives of the model function. In one embodiment, the one or more model function derivatives may include one or more of: a first order derivative of the model function, a second order derivative of the model function, and a third order derivative of the model function. In other embodiments, the one or more model function derivatives also include one or more fourth or higher order derivatives of the model function.

In one embodiment, the one or more model function derivatives may include a zeroth or higher order derivative of the model function, where the zeroth order derivative refers to the model function itself. In other words, the model function itself may be a constraint, for example, by enforcing the relationships between the input values $u_i$ and the target output values $y_i$, although in some embodiments, this constraint may be imposed implicitly or as a consequence of the optimization process.

As also described above, in one embodiment, at least one of the upper and/or lower bounds may be a constant. In another embodiment, at least one of the upper and/or lower bounds may be a function. In a preferred embodiment, the model function has no cross-terms, with the result that the derivatives of the model function have no cross-terms.

In 508, a determination may be made as to whether the model parameters have converged, e.g., whether the model has converged, and if not, then the method may proceed back to 504, where a next at least one input value $u_{i+1}$/target output value $y_{i+1}$ may be selected, and the process repeated, as indicated. In other words, the receiving of 504 and the parameterizing using the optimizer of 506 may be performed iteratively to generate a parameterized model. Thus, in one embodiment, the parameterization process may be iteratively performed to determine parameters in a rigorous simulation model. In one embodiment, the receiving and parameterizing for each at least one input value $u_i$ and each target output value $y_i$ of the training data set may be performed two or more times. In another embodiment, the receiving and parameterizing for each at least one input value $u_i$ and each target output value $y_i$ of the training data set may be performed until the model parameters converge. Thus, parameterization may be performed using an optimization algorithm that allows inequality constraints on functions of the model parameters or variables.

As noted above, in a preferred embodiment, the model may be a multiple input-single output (MISO) model, where the model function accepts an input vector, e.g., u and generates a single output value y, as is the case in equation (6) above. As also noted above, in a preferred embodiment, a plurality of MISO models may be used to model the system or process, where the set of MISO models compose an aggregate model of the system or process. Thus, the providing, receiving, parameterizing, and iteratively performing described above may be performed for each of a plurality of models, wherein the plurality of models compose an aggregate model of the system. Additionally, each of the plurality of models has a respective model function, where each model function preferably has no cross-terms, although embodiments with cross-terms are also contemplated. Each MISO model may represent a respective aspect of the system or process, e.g., in the hydrocarbon reservoir example, each injection well and/or each production well, may have an associated MISO model, or even multiple MISO models, representing the behavior of that respective well.

Thus, applying the method described with reference to FIG. 5 to the plurality of models, providing a training data set comprising a plurality of input values u and a plurality of target output values y for each of said plurality of models may include providing a training data set comprising a plurality of input vectors u and a plurality of target output vectors y, where each input vector $u_i$ includes respective input values for each of the plurality of models, and thus each input vector $u_i$ is an input vector for the aggregate model. Similarly, each target output vector y may include respective target output values for each of the plurality of models, where each target output vector y is a target output vector for the aggregate model. Finally, for each input vector $u_i$, the aggregate model may operate to generate a resulting model output vector $\hat{y}_i$, comprising respective output values for each of the plurality of models.

Thus, various embodiments of the method of FIG. 5 may be applied to parameterize an aggregate model of the system or process.

The resulting parameterized model (the single MISO model and/or the aggregate model) may then be stored in a memory medium, as indicated in 510, and may be usable to analyze the system. For example, the model may be optimized to determine operational parameters of the system for optimal performance of the system, as described below with reference to FIG. 6.

Figure 6:
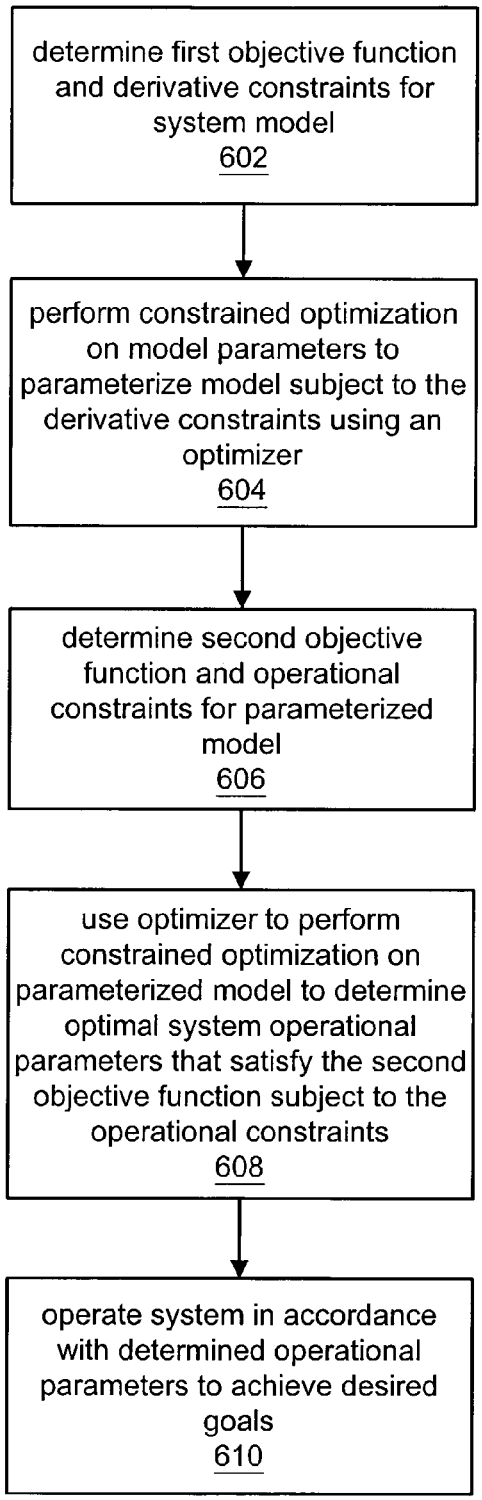
FIG. 6 flowcharts one embodiment of a method for parameterizing and using a predictive model.

FIG. 6—Optimization of the Parameterized Model

FIG. 6 presents a method for generating and using the parameterized model of FIG. 5, according to one embodiment. As noted above, the method described is exemplary, and in various embodiments, two or more of the steps shown may be performed concurrently, in a different order than shown, or may be omitted. Additional steps may also be performed as desired. Note that portions of the method are substantially described above with reference to FIG. 5, the descriptions may be abbreviated.

As shown in FIG. 6, in 602, a first objective function and derivative constraints are determined for the system model, as was described in detail above with reference to FIG. 5. Then, in 604, constrained optimization may be performed with an optimizer on the model parameters to parameterize the model (satisfy the first objective function) subject to the derivative constraints, as described in detail above.

In one embodiment, once the model has been parameterized, then in 606 a second objective function may be determined, where the second objective function represents a desired behavior of the system. Additionally, operational constraints may optionally be determined that reflect bounds or limitations on the operation or behavior of the system. For example, in one embodiment, the second objective function may be to maximize profits, which in the in-situ reservoir example, may be related to the difference between the cost of the injected materials and the value of the hydrocarbon products produced. The operational constraints may include mass balancing, injection pressure limits, and so forth.

Once the second objective function and operational constraints are determined in 606, then in 608, the optimizer and the parameterized model may be used to determine operation of the system that substantially satisfies the second objective function, optionally subject to the operational constraints. Said another way, the optimizer and the parameterized model may then be used to determine operational parameters for the system that attempt to satisfy the second objective function subject to the operational constraints, as is well known in the art. For example, in one embodiment, using the optimizer and the parameterized model to determine operation of the system may include determining one or more operational inputs for the system, where the one or more operational inputs and one or more resulting operational outputs for the system substantially satisfy the second objective function. In one embodiment, operational constraints may be imposed during the optimization process such that the determined operation of the system substantially satisfies the second objective function subject to one or more operational constraints. For example, in the hydrocarbon reservoir example, the optimizer may be used to determine injection rates and/or injection cell pressures for the injection wells that maximize profits, e.g., by maximizing oil production, subject to operational constraints on the system.

Finally, in 610, the system may be operated in accordance with the determined operational parameters to achieve desired goals. In other words, the optimal operational parameters determined with the optimizer and the parameterized model may be used to operate the system. In one embodiment, this may include executing the optimized (and parameterized) model using input data related to operating conditions of the system to determine the operational parameters needed to produce the desired results, then operating the system using the operational parameters. Said another way, once the model has been parameterized and optionally optimized with respect to a desired objective, the parameterized model may be executed to generate resultant data, and the system may be operated in accordance with the resultant data to achieve desired results. In other words, the parameterized model may be executed on a computer to generate data which may be used to operate the system in a substantially optimal manner.

Thus, in the case where the system includes an in-situ hydrocarbon reservoir, in one embodiment, the model may represent operations related to production of the hydrocarbon from the reservoir. For example, in the hydrocarbon reservoir example from above, the injection wells of the reservoir may be operated using the determined injection rates and/or injection cell pressures that may result in increased oil production and/or profitability. Thus, various embodiments of the above method may be used to determine operation of the system that substantially satisfies the second objective function subject to one or more operational constraints, i.e., to determine operational parameters for the system for various goals.

For example, in various embodiments, the optimizer and the parameterized model may be used to determine a combination of injection rates that maximizes production within constraints of injection rate and injector cell pressure, to determine operation of the system for secondary and/or tertiary recovery, to determine one or more completion depths for one or more wells, i.e., where to let the oil enter the wellbore, to determine one or more locations for drilling or shutting in wells, and to determine one or more rates of stimulant injection to maximize production, among others.

In a slightly different embodiment of the above method the optimization problem may first be defined: inputs (u), outputs (y), objective function, and constraints. Then, from engineering knowledge, the allowable ranges on the first, second, and third derivatives may be estimated:

$$\min < \partial y_i / \partial u_j < \max$$

$$\min < \partial^2 y_i / \partial u_j^2 < \max$$

$$\min < \partial^3 y_i / \partial u_j^3 < \max$$

Note that in one embodiment, cross derivatives, e.g., $\partial^2 y_i / \partial u_j \partial u_k$, are not used, as the individual models are built SISO and then combined. In another embodiment the models are built MISO, and cross derivatives are allowed. In yet another embodiment, the models may be MISO, but cross-derivatives may be disallowed or ignored. It is further noted that the third derivative ranges will generally be quite small, e.g., close to zero.

In a more specific example related to the in-situ hydrocarbon reservoir application, where the model comprises a model function and where the one or more derivative constraints comprise upper and/or lower bounds on one or more model function derivatives, the first-order derivative(s) of the model function may include inter-well transmissibilities and/or production indices; the second-order derivative(s) of the model function may include curvature for the inter-well transmissibilities and/or production indices; and the third-order derivative(s) of the model function may include a rate of curvature change for the inter-well transmissibilities and/or production indices.

If data are available from a process, scaling data to span the space wherein the model will be used may be selected. In one embodiment, the scaling data sets the "zeroth" derivatives of the model, i.e., determines the actual range for the model function(s). If data are available from a simulation of the process, a design of experiments method may be used to select the scaling data and make simulation runs to generate it.

An optimization algorithm, e.g., gradient descent, sequential quadratic program, etc., may then be used to parameterize the model. The various inequality constraints may be entered, an objective function determined that penalizes the model for errors in its outputs, and an optimization sequence executed, where the optimizer uses the scaling data as inputs to the model, and uses the model outputs to calculate objective function errors. The optimization algorithm may then update the model parameters to reduce the errors within parameter derivative constraints. As the model behavior converges the "best fit" set of model parameters may be produced. The parameterized model may then be used to solve the original optimization problem posed initially, e.g., using an optimizer. For example, the parameterized model may be executed to generate resultant data, and the system operated in accordance with the resultant data to achieve desired results.

Thus, derivative-constrained parameterization (DCP) may provide several advantages over current predictive modeling techniques used in a wide variety of applications, e.g., hydrocarbon reservoir engineering, etc., including, for example, 1) a rigorous simulation model may not be required in that a compact empirical model with derivative constraints may accurately capture salient aspects of the system behavior; 2) the data required already exists, i.e., data requirements for using the compact empirical model with derivative constraints are substantially less (e.g., perhaps by a factor of 100) than most prior art approaches, and in many cases the required information is readily available, e.g., from reservoir well inspections (e.g., pressures and flows), engineering data and knowledge (e.g., permeability plots), etc.; 3) engineering the model may take weeks instead of months, due to the simplicity of the model and its reduced data requirements; and finally, 4) the derivatives constraints are intuitive. In other words, in general, e.g., in the hydrocarbon reservoir example, the derivative constraints and behaviors represent easily understood phenomena related to the modeled system, and thus may generally be specified in a relatively straightforward manner. For example, as noted above, the first derivatives are known as inter-well transmissibilities and production indices. The second derivatives indicate how much curvature is allowed, and the third derivatives indicate how fast the curvature can change. After some experience with this method a reservoir engineer may become accustomed to adding information in these terms and accurate models may result.

Thus, optimization techniques may be used to both parameterize the system model(s), i.e., by optimizing the model parameters to fit the training data subject to derivative constraints, and to optimize operation of the modeled system, i.e., by optimizing operational system parameters, for example, to meet a production or business objective. Although it should be noted that the two optimization processes are preferably separate and distinct from one another.

Various embodiments further include receiving or storing instructions and/or data implemented in accordance with the foregoing description upon a carrier medium. Suitable carrier media include a memory medium as described above, as well as signals such as electrical, electromagnetic, or digital signals, conveyed via a communication medium such as networks and/or a wireless link.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A computer-implemented method for parameterizing a steady-state model of an in-situ hydrocarbon reservoir, the model having a plurality of model parameters for mapping model input to model output through a stored representation of said reservoir, the method comprising:

providing a training data set comprising a plurality of input values and a plurality of target output values, wherein the training data set is representative of production operations for said reservoir;

receiving a next at least one input value of the plurality of input values and a next target output value of the plurality of target output values;

parameterizing the model with a predetermined algorithm using said next at least one input value and said next target output value, and one or more derivative constraints, wherein the one or more derivative constraints are imposed to constrain relationships between the at least one input value and a resulting model output value, wherein said parameterizing comprises using an optimizer to perform constrained optimization on the plurality of model parameters to satisfy an objective function subject to the derivative constraints;

iteratively performing said receiving and said parameterizing using the optimizer to generate a parameterized model, wherein the model comprises a model function, wherein the one or more derivative constraints comprise upper and/or lower bounds on one or more model function derivatives, wherein one or more of the model function derivatives comprise one or more of:

a first order derivative of the model function, wherein the first order derivative represents inter-well transmissibilities;

a second order derivative of the model function, wherein the second order derivative of the model function represents curvature of the inter-well transmissibilities; and/or a third order derivative of the model function, wherein the third order derivative of the model function represents rate of curvature of the inter-well transmissibilities; and storing the parameterized model in a computer-accessible memory medium, wherein the parameterized model is usable to analyze operations for the reservoir for management of the production operations for the reservoir.

2. The method of claim 1, wherein the objective function comprises:

minimizing an error between the resulting model output value and the target output value.

3. The method of claim 1, wherein said iteratively performing comprises:

performing said receiving and said parameterizing for each at least one input value and each target output value of the training data set two or more times.

4. The method of claim 1, wherein said iteratively performing comprises:

performing said receiving and said parameterizing for each at least one input value and each target output value of the training data set until the model parameters converge.

5. The method of claim 1, wherein said one or more model function derivatives further comprise:

one or more fourth or higher order derivatives of the model function.

6. The method of claim 1, wherein the one or more model function derivatives further comprise a first order derivative representing production indices.

7. The method of claim 6, wherein the one or more model function derivatives further comprise a second order derivative representing curvature of production indices.

8. The method of claim 6, wherein the one or more model function derivatives further comprise a third order derivative representing rate of curvature of production indices.

9. The method of claim 1, wherein said one or more model function derivatives comprise a zeroth or higher order derivative of the model function.

10. The method of claim 1, wherein at least one of said upper and/or lower bounds comprises a constant.

11. The method of claim 1, wherein at least one of said upper and/or lower bounds comprises a function.

12. The method of claim 1, wherein said iteratively performing said receiving and said parameterizing using the optimizer to generate a parameterized model comprises:

determining parameters in a rigorous simulation model, wherein a rigorous simulation model comprises a model that simulates a phenomenon using first principles theory.

13. The method of claim 1, further comprising:

executing the parameterized model to generate resultant data; and operating the reservoir in accordance with the resultant data to achieve a specified objective.

14. The method of claim 1, wherein the model comprises a compact empirical model.

15. The method of claim 1, wherein said one or more derivative constraints comprise:

estimated allowable ranges for one or more derivatives.

16. The method of claim 1, wherein said providing, said receiving, said parameterizing, and said iteratively performing are performed for each of a plurality of models, wherein said plurality of models compose an aggregate model of the reservoir.

17. The method of claim 16, wherein each of the plurality of models comprises a multiple input, single output model.

18. The method of claim 16, wherein each of the plurality of models comprises a respective model function; and wherein each of said one or more model functions has no cross-terms, wherein a cross-term is a term in a function that includes a product of two or more variables.

19. The method of claim 16, wherein each of the plurality of models comprises a respective model function; and wherein each of said one or more model functions comprises a dimensionless group, wherein the dimensionless group comprises a unitless ratio.

20. The method of claim 16, wherein said providing a training data set comprising a plurality of input values and a plurality of target output values for each of said plurality of models comprises:

providing a training data set comprising a plurality of input vectors and a plurality of target output vectors;

wherein each input vector comprises respective input values for each of the plurality of models;

wherein each input vector comprises an input vector for said aggregate model;

wherein each target output vector comprises respective target output values for each of the plurality of models;

wherein each target output vector comprises a target output vector for said aggregate model; and wherein for each input vector, the aggregate model operates to generate a resulting model output vector, comprising respective output values for each of the plurality of models.

21. The method of claim 16, wherein each of the plurality of models comprises a compact empirical model.

22. The method of claim 21, wherein the model comprises a model function;

wherein said one or more derivative constraints comprise upper and/or lower bounds on one or more model function derivatives; and wherein the one or more model function derivatives comprise two or more of:

the first-order derivative of the model function representing inter-well transmissibilities;

the second-order derivative of the model function representing curvature of inter-well transmissibilities; and the third-order derivative of the model function representing rate of curvature change of inter-well transmissibilities.

23. The method of claim 1, further comprising:

determining a second objective function, wherein the second objective function represents a specified objective of reservoir operations; and using the optimizer and the parameterized model to determine operation of the reservoir that satisfies the second objective function.

24. The method of claim 23, wherein said using the optimizer and the parameterized model to determine operation of the reservoir comprises:

determining one or more operational inputs for the reservoir, wherein the one or more operational inputs and one or more resulting operational outputs for the reservoir satisfy the second objective function.

25. The method of claim 23, wherein said using the optimizer and the parameterized model to determine operation of the reservoir comprises:

using the optimizer and the parameterized model to determine operation of the reservoir that satisfies the second objective function subject to one or more operational constraints.

26. The method of claim 23, wherein said using the optimizer and the parameterized model to determine operation of the reservoir that satisfies the second objective function subject to one or more operational constraints comprises:

determining a combination of injection rates that maximizes production within constraints of injection rate and injector cell pressure.

27. The method of claim 23, wherein said using the optimizer and the parameterized model to determine operation of the reservoir that satisfies the second objective function subject to one or more operational constraints comprises:

determining operation of the reservoir for secondary and/or tertiary recovery.

28. The method of claim 23, wherein said using the optimizer and the parameterized model to determine operation of the reservoir that satisfies the second objective function subject to one or more operational constraints comprises:

determining one or more completion depths for one or more wells.

29. The method of claim 23, wherein said using the optimizer and the parameterized model to determine operation of the reservoir that satisfies the second objective function subject to one or more operational constraints comprises:

determining one or more locations for drilling or shutting in wells.

30. The method of claim 23, wherein said using the optimizer and the parameterized model to determine operation of the reservoir that satisfies the second objective function subject to one or more operational constraints comprises:

determining one or more rates of stimulant injection to maximize production.

31. The method of claim 23 wherein said using the optimizer and the parameterized model to determine operation of the reservoir that satisfies the second objective function comprises using the optimizer and the parameterized model to determine operational parameters of the reservoir that satisfy the second objective function, the method further comprising:

operating the reservoir in accordance with the determined operational parameters to achieve a specified objective.

32. A computer-based system for parameterizing a steady-state model of an in-situ hydrocarbon reservoir, the model having a plurality of model parameters for mapping model input to model output through a stored representation of said reservoir, the system comprising:

a computer, comprising:

a processor; and a memory medium coupled to the processor;

an input coupled to the processor and the memory medium, wherein the input is operable to receive a training data set comprising a plurality of input values and a plurality of target output values, wherein the training data set is representative of production operations of said reservoir; and an output coupled to the processor and the memory medium;

wherein the memory medium stores program instructions which are executable by the processor to:

receive a next at least one input value of the plurality of input values and a next target output value of the plurality of target output values;

parameterize the model with a predetermined algorithm using said next at least one input value and said next target output value, and one or more derivative constraints, wherein the one or more derivative constraints are imposed to constrain relationships between the at least one input value and a resulting model output value, wherein said parameterizing comprises using an optimizer to perform constrained optimization on the plurality of model parameters to satisfy an objective function subject to the derivative constraints;

iteratively perform said receiving and said parameterizing using the optimizer to generate a parameterized model, wherein the model comprises a model function, wherein the one or more derivative constraints comprise upper and/or lower bounds on one or more model function derivatives, wherein one or more of the model function derivatives comprise one or more of:

a first order derivative of the model function, wherein the first order derivative represents inter-well transmissibilities;

a second order derivative of the model function, wherein the second order derivative of the model function represents curvature of the inter-well transmissibilities; and/or a third order derivative of the model function, wherein the third order derivative of the model function represents rate of curvature of the inter-well transmissibilities; and store the parameterized model in the memory medium, wherein the parameterized model is usable to analyze reservoir operations; and wherein the output is operable to provide the parameterized model and/or the resulting model output values to other systems or processes to manage the reservoir operations.

33. The system of claim 32, wherein the objective function comprises:

minimization of an error between the model output value and the target output value.

34. The system of claim 32, wherein, in iteratively performing, the program instructions are executable to:

perform said receiving and said parameterizing for each at least one input value and each target output value of the training data set two or more times.

35. The system of claim 32, wherein, in iteratively performing, the program instructions are executable to:

perform said receiving and said parameterizing for each at least one input value and each target output value of the training data set until the model parameters converge.

36. The system of claim 32, wherein the program instructions are further executable to:

execute the parameterized model to generate resultant data; and operate the reservoir in accordance with the resultant data to achieve a specified objective.

37. The system of claim 32, wherein the model comprises a compact empirical model.

38. The system of claim 32, wherein said one or more model function derivatives further comprise:

one or more fourth or higher order derivatives of the model function.

39. The system of claim 32, wherein said one or more model function derivatives comprise a zeroth or higher order derivative of the model function.

40. The system of claim 32, wherein at least one of said upper and/or lower bounds comprises a constant.

41. The system of claim 32, wherein at least one of said upper and/or lower bounds comprises a function.

42. The system of claim 32, wherein said one or more derivative constraints comprise:

estimated allowable ranges for one or more derivatives.

43. The system of claim 32, wherein the program instructions are operable to perform said providing, said receiving, said parameterizing, and said iteratively performing for each of a plurality of models, wherein said plurality of models compose an aggregate model of the reservoir.

44. The system of claim 43, wherein each of the plurality of models comprises a multiple input, single output model.

45. The system of claim 43, wherein each of the plurality of models comprises a respective model function; and wherein each of said model functions has no cross-terms, wherein a cross-term is a term in a function that includes a product of two or more variables.

46. The system of claim 43, wherein each of the plurality of models comprises a respective model function; and wherein each of said one or more model functions comprises a dimensionless group, wherein the dimensionless group comprises a unitless ratio.

47. The system of claim 43, wherein, in performing said providing a training data set comprising a plurality of input values and a plurality of target output values for each of said plurality of models, the program instructions are further executable to:

provide a training data set comprising a plurality of input vectors and a plurality of target output vectors;

wherein each input vector comprises respective input values for each of the plurality of models;

wherein each input vector comprises an input vector for said aggregate model;

wherein each target output vector comprises respective target output values for each of the plurality of models;

wherein each target output vector comprises a target output vector for said aggregate model; and wherein for each input vector, the aggregate model operates to generate a resulting model output vector, comprising respective output values for each of the plurality of models.

48. The system of claim 43, wherein each of the plurality of models comprises a compact empirical model.

49. The system of claim 32, wherein the model represents operations related to production of the hydrocarbons from the reservoir.

50. The system of claim 49, wherein the model comprises a model function;

wherein said one or more derivative constraints comprise upper and/or lower bounds on one or more model function derivatives; and wherein the one or more model function derivatives comprise two or more of:

the first-order derivative of the model function representing inter-well transmissibilities;

the second-order derivative of the model function representing curvature of inter-well transmissibilities; and the third-order derivative of the model function representing rate of curvature change of inter-well transmissibilities.

51. The system of claim 32, wherein the program instructions are further executable to:

receive a second objective function, wherein the second objective function represents a specified objective of reservoir operations; and use the optimizer and the parameterized model to determine operation of the reservoir that satisfies the second objective function.

52. The system of claim 51, wherein, in using the optimizer and the parameterized model to determine operation of the reservoir, the program instructions are further executable to:

determine one or more operational inputs for the reservoir, wherein the one or more operational inputs and one or more resulting operational outputs for the reservoir satisfy the second objective function.

53. The system of claim 51, wherein, in using the optimizer and the parameterized model to determine operation of the reservoir, the program instructions are further executable to:

use the optimizer and the parameterized model to determine operation of the reservoir that satisfies the second objective function subject to one or more operational constraints.

54. The system of claim 51, wherein, in using the optimizer and the parameterized model to determine operation of the reservoir that satisfies the second objective function subject to one or more operational constraints, the program instructions are further executable to:

determine a combination of injection rates that maximizes production within constraints of injection rate and injector cell pressure.

55. The system of claim 51, wherein, in using the optimizer and the parameterized model to determine operation of the reservoir that satisfies the second objective function subject to one or more operational constraints, the program instructions are further executable to:

determine operation of the reservoir for secondary and/or tertiary recovery.

56. The system of claim 51, wherein, in using the optimizer and the parameterized model to determine operation of the reservoir that satisfies the second objective function subject to one or more operational constraints, the program instructions are further executable to:

determine one or more completion depths for one or more wells.

57. The system of claim 51, wherein, in using the optimizer and the parameterized model to determine operation of the reservoir that satisfies the second objective function subject to one or more operational constraints, the program instructions are further executable to:

determine one or more locations for drilling or shutting in wells.

58. The system of claim 51, wherein, in using the optimizer and the parameterized model to determine operation of the reservoir that satisfies the second objective function subject to one or more operational constraints, the program instructions are further executable to:

determine one or more rates of stimulant injection to maximize production.

59. The system of claim 51, wherein said using the optimizer and the parameterized model to determine operation of the reservoir that satisfies the second objective function comprises using the optimizer and the parameterized model to determine operational parameters of the reservoir that satisfy the second objective function, the program instructions are further executable to:

operate the reservoir in accordance with the determined operational parameters to achieve a specified objective.

60. The system of claim 32, wherein, in iteratively performing said receiving and said parameterizing using the optimizer to generate a parameterized model, the program instructions are further executable to:

determine parameters in a rigorous simulation model of the reservoir, wherein a rigorous simulation model comprises a model that simulates a phenomenon using first principles theory.

61. A computer readable memory medium which stores program instructions for parameterizing a steady-state model of an in-situ hydrocarbon reservoir, the model having a plurality of model parameters for mapping model input to model output through a stored representation of said reservoir, wherein the program instructions are executable by a processor to perform:

providing a training data set comprising a plurality of input values and a plurality of target output values, wherein the training data set is representative of operation of the reservoir;

receiving a next at least one input value of the plurality of input values and a next target output value of the plurality of target output values;

parameterizing the model with a predetermined algorithm using said next at least one input value and said next target output value, and one or more derivative constraints, wherein the one or more derivative constraints are imposed to constrain relationships between the at least one input value and a resulting model output value, wherein said parameterizing comprises using an optimizer to perform constrained optimization on the plurality of model parameters to satisfy an objective function subject to the derivative constraints;

iteratively performing said receiving and said parameterizing using the optimizer to generate a parameterized model, wherein the model comprises a model function, wherein the one or more derivative constraints comprise upper and/or lower bounds on one or more model function derivatives, wherein one or more of the model function derivatives comprise one or more of:

a first order derivative of the model function, wherein the first order derivative represents inter-well transmissibilities;

a second order derivative of the model function, wherein the second order derivative of the model function represents curvature of the inter-well transmissibilities; and/or a third order derivative of the model function, wherein the third order derivative of the model function represents rate of curvature of the inter-well transmissibilities; and storing the parameterized model in a memory medium, wherein the parameterized model is usable to analyze operations of the reservoir.

62. A system for parameterizing a steady-state model of an in-situ hydrocarbon reservoir, the model having a plurality of model parameters for mapping model input to model output through a stored representation of said reservoir, the system comprising:

means for providing a training data set comprising a plurality of input values and a plurality of target output values, wherein the training data set is representative of operation of the reservoir;

means for receiving a next at least one input value of the plurality of input values and a next target output value of the plurality of target output values;

means for parameterizing the model with a predetermined algorithm using said at least one next input value and said next target output value, and one or more derivative constraints, wherein the one or more derivative constraints are imposed to constrain relationships between the at least one input value and a resulting model output value, wherein said parameterizing comprises using an optimizer to perform constrained optimization on the plurality of model parameters to satisfy an objective function subject to the derivative constraints;

means for iteratively performing said receiving and said parameterizing using the optimizer to generate a parameterized model, wherein the model comprises a model function, wherein the one or more derivative constraints comprise upper and/or lower bounds on one or more model function derivatives, wherein one or more of the model function derivatives comprise one or more of:

a first order derivative of the model function, wherein the first order derivative represents inter-well transmissibilities;

a second order derivative of the model function, wherein the second order derivative of the model function represents curvature of the inter-well transmissibilities; and/or a third order derivative of the model function, wherein the third order derivative of the model function represents rate of curvature of the inter-well transmissibilities; and means for storing the parameterized model in a memory medium, wherein the parameterized model is usable to analyze operations for the reservoir.

* * * * *